US007842136B2

(12) United States Patent
Giefer et al.

(10) Patent No.: US 7,842,136 B2
(45) Date of Patent: Nov. 30, 2010

(54) DEVICE AND METHOD FOR COLLECTING WASTEWATER IN DISHWASHERS

(75) Inventors: Heinz-Werner Giefer, Sontheim (DE); Georg Hechtl, Dillingen (DE); Hans-Peter Nannt, Gerstetten (DE); Horst Sipple, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/542,835

(22) Filed: Aug. 18, 2009

(65) Prior Publication Data

US 2010/0037917 A1 Feb. 18, 2010

Related U.S. Application Data

(60) Division of application No. 10/879,929, filed on Jun. 28, 2004, now Pat. No. 7,597,108, which is a continuation of application No. PCT/EP02/13316, filed on Nov. 26, 2002.

(30) Foreign Application Priority Data

Dec. 28, 2001 (DE) ..... 101 64 507

(51) Int. Cl.
*A47L 15/42* (2006.01)

(52) U.S. Cl. ..... 134/10; 134/104.4

(58) Field of Classification Search ..... 134/10
See application file for complete search history.

(56) References Cited

U.S. PATENT DOCUMENTS 3,476,600 A * 11/1969 Selmeczi et al. ..... 134/10
4,848,382 A * 7/1989 Bertsch et al. ..... 134/111

* cited by examiner

*Primary Examiner*—Michael Barr
*Assistant Examiner*—Jason P Riggleman
(74) *Attorney, Agent, or Firm*—James E. Howard; Andre Pallapies

(57) ABSTRACT

A device and method for handling waste water to-be-discharged out of a dishwashing machine that includes a pump well and a sump section, with the sump section communicating with the pump well in the lower regions of the dishwashing machine through an inflow section. The device also contains a valve located in or operating with the inflow section that blocks the influx of waste water from the pump well into the sump section when the valve is closed. The valve allows the influx of waste water from the pump well into the sump section when the valve is opened.

4 Claims, 1 Drawing Sheet

DEVICE AND METHOD FOR COLLECTING WASTEWATER IN DISHWASHERS

CROSS REFERENCE TO RELATED APPLICATIONS

This application claims the benefit of, and is a Divisional (under 35 U.S.C. §121) of U.S. application Ser. No. 10/879,929, filed Jun. 28, 2004, which is a continuation, under 35 U.S.C. §120, of International Application No. PCT/EP02/13316, filed Nov. 26, 2002, which designated the United States; this application also claims the benefit (under 35 U.S.C. §119) of German patent application No. 101 64 507.4, filed Dec. 28, 2001. The entire disclosures of the above-identified prior applications, including the drawings, are incorporated herein by reference.

BACKGROUND OF THE INVENTION

The object of the present invention is a device for collecting wastewater in dishwashing machines with a pump well and a sump section arranged in its lower region, which is connected via an inflow section to the pump well, and a method for collecting wastewater in a dishwashing machine.

DE 30 33 026 A1 discloses a dishwashing machine for carrying out a method for removing food residues, whereby a sump floor is provided in the lower region of a pump well, which has in its lower region a sump section, connected via an inflow section to the pump well. The result of different structures on the sump wall of the sump floor should be to cause a rotation of the liquid contained therein containing food residues, with the result that the more solid constituents, i.e. the food residues in the waste water are moved to the rotation point in accordance with physical laws. Located in the rotation point finally is the inflow section leading from the pump well to the sump section, where the sump section is connected to an emptying pump. In order to convey the food residues sinking to the sump floor during circulating of the washing liquid faster to the opening in the suction connection of the emptying pump located in the sump floor, and, to prevent food residues gathered there from whirling up, guide elements for the washing liquid are provided on the sump floor aligned axially, tangentially or helically to the centre of the floor, for example.

This device has proven to be disadvantageous, in that separate means (pumps, for example) must be provided to introduce the cyclic flow, and the wastewater in the pump well containing food residues must be completely emptied for cleaning.

BRIEF SUMMARY OF THE INVENTION

The object of the present invention therefore is to provide a device and a method for collecting waste water or a to-be-discharged fluid in dishwashing machines of the type described at the outset, which enables reliable separation of waste water containing food residues, in order to finally substantially reduce the water consumption of dishwashing machines.

This task is solved according to the present invention by a device for collecting wastewater in dishwashing machines having the characteristics as claimed herein and by an inventive method for collecting wastewater in a dishwashing machine as discussed hereinafter. Advantageous further developments and features of the present invention are characterized in the independent claim or claims.

The average water consumption during a wash cycle can be drastically reduced by using the inventive device for collecting waste water in dishwashing machines, because only the waste water contaminated with food residues is conveyed to the lye pump and discharged, while the waste water only slightly contaminated with food residues is lead to the circulating pump and can flow back again into the liquid cycle.

At the beginning of a wash cycle the coarse and light detachable food residues clinging to crockery are loosened by the effect of water jets and sent down to the pump well. With the inventive device for collecting wastewater in dishwashing machines the food residues sinking in the pump well are guided through precise opening and closing of a valve located in a sump section under the pump well and discharged there via a lye pump. The wastewater remaining in the pump well now contains only smaller floating dirt particles, which can be recirculated into the wash cycle via the circulating pump.

In a particularly advantageous embodiment of the inventive device for collecting waste water in dishwashing machines the valve arranged in the inflow section to the sump section is also controlled during the circulation procedure to convey those dirt particles, for example only later loosened from crockery or cutlery, which have sunk to the floor of the pump well, into the subjacent sump section. Effectively a vent, which provides pressure equalisation in the sump section, is provided in the sump section, since the circulating or lye pump would quickly generate subpressure in the sump section if the valve were closed, which could negatively influence both the efficiency of the pumps and the materials of the sump body being used, in particular when larger volumes of liquid are being suctioned off.

In a particularly advantageous manner the valve of the inventive device for collecting waste water in dishwashing machines is designed to be controlled by the wash cycle, so that for example when a wash cycle for particularly soiled loads is actuated a wait is made for numerous food residues to sink into the pump well or this is repeatedly carried out to suction off these accumulated food residues through the sluice-like sump section.

According to the inventive method for collecting waste water in dishwashing machines, in particular using an inventive device for collecting waste water in dishwashing machines the waste water collects in a pump well, which is connected to a sump section arranged underneath via a valve into an inflow section, and this valve is opened or blocked as required to let at least a partial quantity of the waste water to flow into the sump section, and at least this accumulated partial quantity of waste water is pumped out via a lye or circulating pump, thus drastically reducing the average water consumption during a wash cycle, because only the waste water contaminated with food residues is lead to the lye pump and discharged, while the waste water contaminated only slightly with food residues is lead to the circulating pump and can recirculate to the washing cycle.

The present invention has succeeded in providing a device and a method for collecting waste water in dishwashing machines of the type described at the outset, which enables reliable separation of waste water containing food residues in order to substantially reduce the water consumption of dishwashing machines.

BRIEF DESCRIPTION OF THE DRAWINGS

An exemplary embodiment of the invention is described in greater detail hereinbelow with reference to FIG. 1.

DESCRIPTION OF EXEMPLARY EMBODIMENTS

Figure 1:
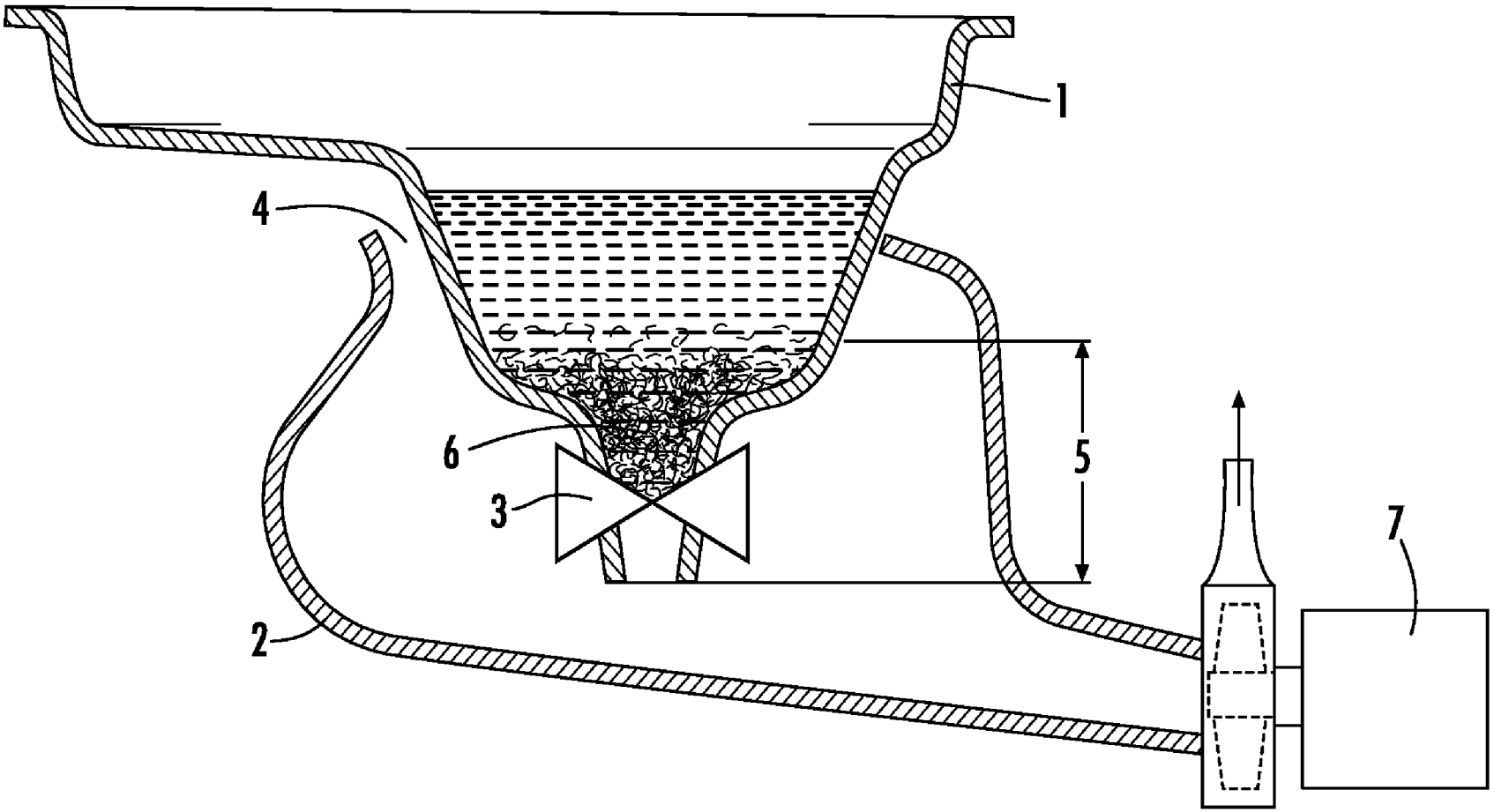
FIG. 1 shows a schematic cross-section through a pump well and a sump section situated below to which a circulating/lye pump is connected.

At the beginning of a wash cycle, the coarse and easily loosened food residues clinging to the crockery and as the wash cycle continues the more stubborn food residues are also naturally loosened by the effect of waterjets. After the food residues clinging to the items to be washed they sink down on account of gravity and form a sump 6 in the pump well 1. Depending on the quantity of food residues the inflow section 5 in the lower region of the pump well 1 fills up accordingly with food residues. From a certain quantity or depending on a preset interval the valve 3 is opened and remains open according to a predetermined time, which is fixed in the wash cycle, in order to supply the sump 6, in particular the sump 6 containing food residues from the pump well 1 to the sump section 2. As soon as this sump 6 has been supplied from the pump well 1 into the sump section 2 through the inflow section 5, the valve 3 closes. The sump 6 located in the sump section 2 is pumped out by the pumping function (lye pump function) of the circulating/lye pump 7. From now on the valve 3 can be reopened and wastewater containing only minimal food residues can be recycled through the circulating pump function of the circulating/lye pump 7 to the wash cycle. To avoid sub pressure situations in the sump section 2 the latter has a vent 4, which ensures in particular that both the circulating/lye pump 7 and the material of the sump section 2 is not stressed unnecessarily when larger volumes of waste water are being suctioned off in the contamination region 2. Alternatively two separate pumps can be provided instead of a combined circulating/lye pump 7.

What is claimed is:

1. A method for removing a to-be-discharged fluid out of a lower region of a dishwashing machine, the dishwashing machine comprising:

a discharge path along which a to-be-discharged fluid is discharged from the lower region of the dishwashing machine, the discharge path extending from a pass on location in the lower region of the dishwashing machine to a discharge location at which the to-be-discharged fluid is discharged from the dishwashing machine;

a recirculation start path along which a recirculable fluid is forwarded from the lower region of the dishwashing machine, the recirculation start path extending from a take over location in the lower region of the dishwashing machine to an exit location beyond which the recirculable fluid flows further to a washing volume of the dishwashing machine; and an upstream segment along which flows all fluid that has reached the lower region of the dishwashing machine, the upstream segment being communicated with the pass on location associated with the discharge path and the take over location associated with the recirculation start path such that all to-be-discharged fluid flows, on the one hand, through the upstream segment to the pass on location associated with the discharge path and thereafter flows along the discharge path to the discharge location or, on the other hand, all recirculable fluid flows through the upstream segment to the take over location associated with the recirculation start path and thereafter flows along the recirculation start path to the exit location of the recirculation start path, the upstream segment being formed of:

a pump well, a sump section communicated with and below the pump well, an inflow section comprising one and only one outlet whereby all to-be-discharged fluid or all recirculable fluid flows wherein the inflow section of the pump well extends into and inside of the sump section and wherein the top of the sump section is open to the external environment to form a vent and wherein the top of the sump section is above a valve for selectively opening and closing the inflow section to control the flow of fluid from the pump well into the sump section, the method comprising:

collecting fluid in the pump well;

controlling the fluid flow through the valve to advance all to-be-discharged fluid successively through the pump well, the inflow section, and the sump section, whereupon all to-be-discharged fluid is thereafter flowed into the discharge path for ultimate discharge at the discharge location; and controlling the fluid flow through the valve to advance all recirculable fluid successively through the pump well, the inflow section, and the sump section, whereupon all recirculable fluid is thereafter flowed into the recirculation start path for ultimate forwarding beyond the exit location to the washing volume of the dishwashing machine.

2. The method of claim 1, wherein the dishwashing machine further comprises a controller for controlling the valve (a) to open during one portion of a respective washing cycle of the dishwashing machine for transfer of to-be-discharged fluid through the discharge path via which the to-be-discharged fluid is discharged from the dishwasher, (b) to thereafter close the valve, whereupon fluid thereafter arriving in the lower region of the dishwasher is collected in the pump well, and (c) to thereafter open the valve during a later portion of the respective washing cycle of the dishwashing machine for flow of recirculable fluid along the recirculation start path via which the recirculable fluid is recirculated to a washing volume of the dishwasher.

3. The method of claim 1, wherein the dishwasher further comprises a lye pump that is communicated with the sump section through which all to-be-discharged fluid is pumped out of the sump section.

4. The method of claim 1, wherein the dishwasher further comprises a circulating pump that is communicated with the sump section through which all recirculable fluid is pumped out of the sump section.

* * * * *